US009142922B2

(12) United States Patent
Regnier et al.

(10) Patent No.: US 9,142,922 B2
(45) Date of Patent: Sep. 22, 2015

(54) CONNECTOR ASSEMBLY WITH IMPROVED COOLING CAPABILITY

(75) Inventors: Kent E. Regnier, Lombard, IL (US); Harold Keith Lang, Cary, IL (US)

(73) Assignee: Molex Incorporated, Lisle, IL (US)

( * ) Notice: Subject to any disclaimer, the term of this patent is extended or adjusted under 35 U.S.C. 154(b) by 737 days.

(21) Appl. No.: 13/256,102

(22) PCT Filed: Mar. 9, 2010

(86) PCT No.: PCT/US2010/026650

§ 371 (c)(1), (2), (4) Date: Nov. 22, 2011

(87) PCT Pub. No.: WO2010/104847

PCT Pub. Date: Sep. 16, 2010

(65) Prior Publication Data

US 2012/0058670 A1 Mar. 8, 2012

Related U.S. Application Data

(60) Provisional application No. 61/159,029, filed on Mar. 10, 2009.

(51) Int. Cl.

| | |
|---|---|
| ***H01R 13/648*** | (2006.01) |
| ***H01R 13/658*** | (2011.01) |
| ***H01R 12/50*** | (2011.01) |
| ***H01R 13/6586*** | (2011.01) |
| *H01R 13/6596* | (2011.01) |

(52) U.S. Cl.

CPC ..... *H01R 13/65802* (2013.01); *H01R 13/6586* (2013.01); *H01R 23/6873* (2013.01); *H01R 13/6596* (2013.01)

(58) Field of Classification Search

CPC ..... H01R 13/6586; H01R 13/65802

USPC ..... 439/541.5, 607.21, 607.04, 607.23

See application file for complete search history.

(56) References Cited

U.S. PATENT DOCUMENTS

| | | | | |
|---|---|---|---|---|
| 6,517,382 | B2 * | 2/2003 | Flickinger et al. | 439/607.23 |
| 6,731,519 | B1 | 5/2004 | Hwang | |
| 7,037,136 | B1 * | 5/2006 | Korsunsky et al. | 439/607.07 |
| 7,070,446 | B2 | 7/2006 | Henry et al. | |
| 7,641,515 | B1 | 1/2010 | Szczesny et al. | |
| 2005/0037655 | A1 | 2/2005 | Henry et al. | |
| 2009/0098767 | A1 * | 4/2009 | Long | 439/541.5 |

FOREIGN PATENT DOCUMENTS

WO WO 2008/094655 A2 8/2008

OTHER PUBLICATIONS

International Search Report for PCT/US2010/026650.

* cited by examiner

*Primary Examiner* — Briggitte R Hammond

(74) *Attorney, Agent, or Firm* — Stephen L. Sheldon

(57) ABSTRACT

A connector includes a cage that has two side walls, a top cover and a rear wall that are combined to form a hollow enclosure. The enclosure is separated into two module-receiving bays by at least one spacer with a top and bottom wall that extends between the sidewalls to form a central portion between a top and bottom bay, the central portion acting as an air passage between a front face and the sides of the connectors. Air openings are formed in the sidewalls of the cage assembly and they communicate with the central portion. The bottom wall of the spacer is provided with a large opening that extends a substantial distance of module-receiving bay and provides an air flow path from the air openings to the bottom module-receiving bay. An insert with apertures in communication with the central portion can be positioned.

15 Claims, 20 Drawing Sheets

CONNECTOR ASSEMBLY WITH IMPROVED COOLING CAPABILITY

REFERENCE TO RELATED APPLICATIONS

This application is a national phase of PCT Application No. PCT/US2010/026650, filed Mar. 10, 2010, which in turn claims priority to U.S. Provisional Application No. 61/159,029, filed Mar. 10, 2009, both of which are incorporated herein by referenced in their entirety.

BACKGROUND OF THE INVENTION

The present invention relates generally to high speed pluggable connectors, and more particularly, to shielded, pluggable connectors with improved cooling capabilities.

Moore's Law, which is more properly termed an observation, is based on the understanding that in the field of integrated circuits, the complexity (or number of circuits) will double every two years. The fact that this observation has held true since about 1965 has had a remarkable impact on the world as we know it. Computation speeds that were in the realm of science fiction have become a reality. Moore's Law, as it is known, continues and while there appear to be fundamental physical limits to how small an integrated circuit can be made, other technologies may provide substitutes that allow the effect (the doubling of performance every two years) to continue for the foreseeable future.

One consequence of the increase in performance is that data needs to be transmitted at increasing rates. Data transmission rates that were unthinkable just a few years ago are a current reality and faster data transmission speeds are being planned into next generation products. For example, current data transmission rates that are used in the telecommunications industry are 12 to 15 Gbps (gigabits/second) and rates of 25 to 30 Gbps are already on the horizon. The increase (or desire for an increase) in data transmission rates affects the entire data infrastructure. For example, as part of their computer network companies will often employ servers and routers (which may be referred to as data-handling devices) so that computers in the company can communicate and access data in a desirable manner. These data-handling devices can be connected together by cable assemblies which utilize two plug connectors terminated to a length of cable. The plug connectors often take the form of electronic, pluggable modules that are inserted into an opening in the data-handling devices so as to mate with and engage an opposing mating connector. Within the data-handling devices, connectors are mounted to a circuit board and a cage typically surrounds the connector. The cage defines a hollow enclosure that envelops the component connector and within the enclosure, a module-receiving channel or bay is defined so that a module can be inserted into the channel. In operation, this allows the two data-handling devices to communicate with each other at high data rates.

The shielding provided by the cage is used to reduce electromagnetic interference (EMI) that may be emitted, for example, from other nearby connectors. Because of the high frequencies used to transmit the date, it is desirable to make the cage continuous so that no openings are provided to allow for high-frequency signals to enter and affect the intended signals moving through the connectors. However, with the increase in shielding comes a resultant poor airflow over the module. This lack of air-flow can create problems because at higher data rates the amount of energy passing through the connector increases and the increased energy increases the amount of heat that the connector has to dissipate. While the use of a heat sink has helped address this heat dissipation issue, one configuration that has been difficult to address is a stacked connector configuration is used. While air can be directed over the top of a stacked connector (the top of which can readily include a heat sink with fins to help dissipate heat), the lower connector is effectively sandwiched between an insulating circuit board and a heat generating module, making cooling particularly challenging. A known solution to this type of problem has been to mount the connectors belly to belly with heat sinks on opposite sides of the cages. As can be appreciated, however, this creates problems in plugging in modules because some modules will need to be turned upside down and it can be difficult to tell which way to turn the module when a person is facing a number of rows of such connectors. Furthermore, the split orientation of the connectors limits the interface with the circuit board that supports the connectors. Therefore, improvements in connector designs that could accommodate high heat loads would be appreciated.

SUMMARY OF THE INVENTION

In an embodiment, a cage with improved cooling capability is provided for a stacked connector. The cage is formed from a plurality of walls including a top wall, a bottom wall, two side walls and a rear wall. These walls cooperatively define a hollow enclosure with an interior space that envelops a housing. The hollow enclosure is divided into at least an upper and lower bay and includes a central portion positioned between the upper and lower bay and defined, at least in part by a spacer. In operation, a pluggable module can be inserted into the bays so that an edge-card can be inserted into the corresponding slot(s) and contact pads on the edge card can engage terminals supported by the housing. The central portion includes a front face with apertures so that air can be drawn into the center portion through the front face. The side walls include apertures aligned with the center portion so that air can be drawn out of the center portion. In this manner, when the cage is positioned in an enclosure that has a negative internal pressure, air will flow through the apertures in the front face and out the apertures in the side wall so as to provide cooling. In an embodiment, the cage may be a ganged cage with two or more sets of upper and lower bays positioned side by side and separated by a dividing wall. The dividing wall may also have apertures aligned with the center portion so as to facilitate air flow into and out of the center portion in a desired manner.

BRIEF DESCRIPTION OF THE DRAWINGS

In the following detailed description, reference will be made to the following drawings wherein like reference numbers refer to like parts and wherein.

DETAILED DESCRIPTION OF THE PREFERRED EMBODIMENTS

Figure 1:
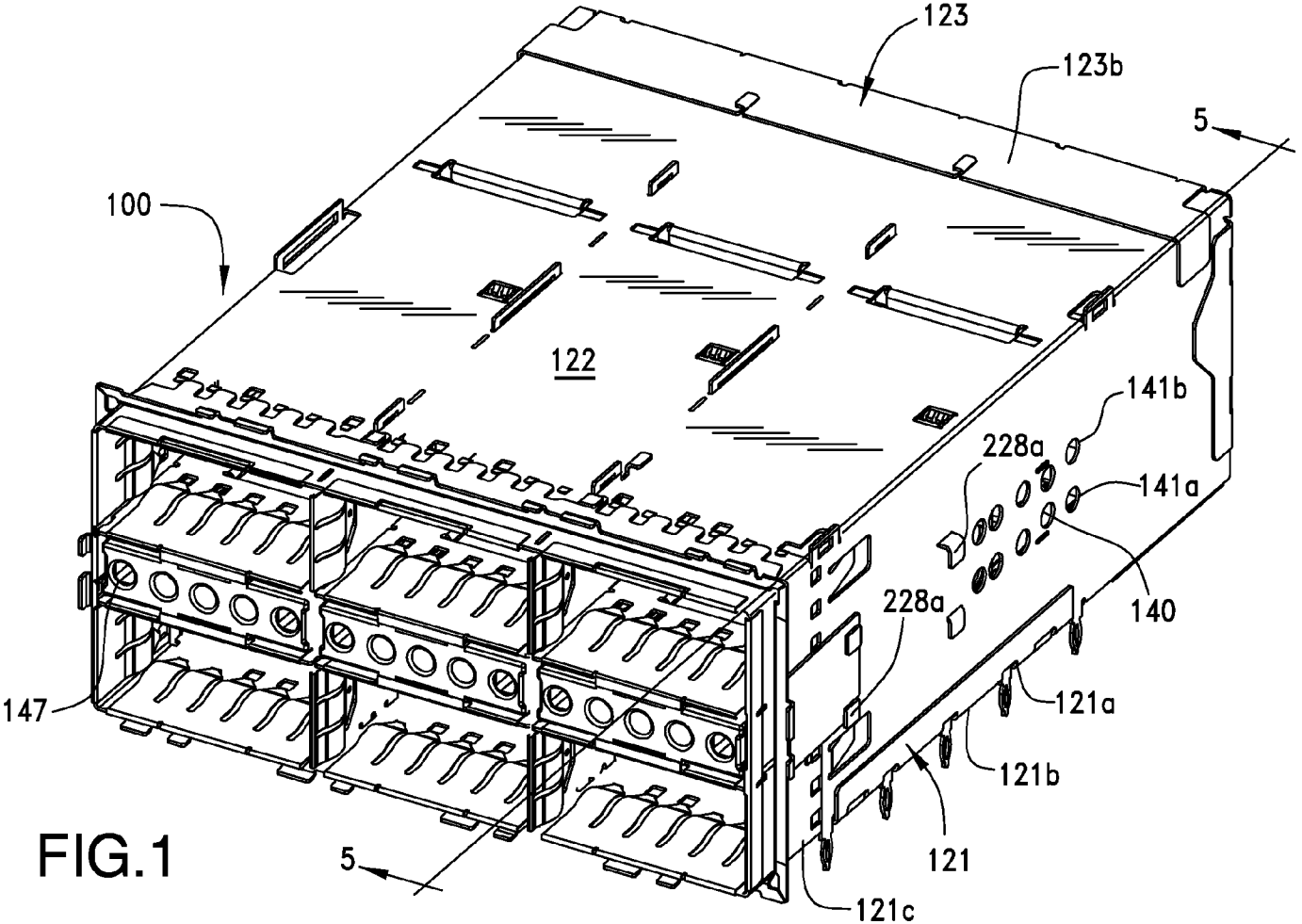
FIG. 1 is a perspective view of a 2×3 ganged cage connector assembly.

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Before looking at the figures, it should be noted that a number of different methods of assembling walls together to form the cage assembly. In general, a stacked cage assembly may include a first wall and a second wall that are used to form sides of the cage assembly. The cage assembly may further include a third wall that extends between the first and second wall to form a top of the cage assembly. A fourth wall may extend between the first and second wall to form a back wall. A fifth and sixth wall may be positioned so as to extend between the first and second wall in an orientation that is substantially parallel to each near the middle of the first and second wall (thus helping to form a first channel above the fifth wall and a second channel below the sixth wall, the first and second channel opening in a front of the cage assembly). The sixth wall is positioned below the fifth wall and includes an aperture so that a module inserted in the second channel is in communication with a space between the fifth and second wall. The aperture may be configured to provide an open area of at least 250 $mm^2$ and in an embodiment may provide about 360-380 $mm^2$. The percentage of area of the aperture to the area of the sixth wall may be greater than twenty five (25) percent and in an embodiment the aperture may cover between about thirty five (35) and fifty (50) percent of the area covered by the portion of the sixth wall that forms part of the second channel. As can be appreciated, this provides a substantial opening that allows for a significant level of convective heat transfer.

As is discussed below, an insert may be positioned between the fifth and sixth wall and the insert may be a dielectric. If used, the insert provides openings that allow air to flow past the insert into the space between the fifth and sixth wall. When the cage assembly is mounted in a bezel, openings in the bezel will allow air to flow through past the bezel, past the insert (if provided), over the aperture in the sixth wall (thus causing heat to convect away from a module inserted in the second channel) and then pass out through side apertures in the first and second wall. To promote good air flow patterns, the side apertures may be positioned so that for a given channel length, they are not positioned in the first third portion of the channel. As can be appreciated, therefore, this creates a triangular arrangement between the front openings, the aperture in the fifth wall and the side apertures. If the connector is positioned in an enclosed container and a negative pressure is provided on the interior of the container (e.g., by using a fan to push or pull air out of the container), air will flow through the front opening, over the module and out the side apertures. Thus, the space between the fifth and sixth wall can function as a plenum. As can be appreciated, in a ganged connector configuration, the air will pass through the middle plenum and into the two surrounding plenums before exiting the cage assembly. Thus, a relatively efficient air-flow pattern is possible that can provide good cooling without higher airflow rates.

The second channel can be defined as having a length that extends from the front of the cage to a portion of the connector that supports connector slots. To improve the effectiveness of the air flow, as noted above, the side apertures may be positioned so that they are not in the first third portion of the channel. In an embodiment, the side apertures may start at the midpoint of the channel and in another embodiment may be at least 60 percent of the channel length away from the front of the channel.

It has been determined that while the cooling is generally beneficial, a cage assembly configured to provide the described air-flow configuration is beneficial when the module is generating more than 1 watt of heat. Furthermore, as the heat load increases, the need for a cooling system such as is depicted increases. To handle higher heat loads such as two or three watts, significant air flow is still beneficial. In an embodiment, a ganged connector (such as depicted in FIG. 1) can be configured so that between 50 and 90 CFM can pass through the combined plenum area. This level of air flow, in combination with additional air flow in the range of 100-200 or more CFM over the top of the cage (which may include a heat sink) can be sufficient to cool the modules even when generating higher heat loads while still allowing a stacked configuration that keeps both modules in the same orientation.

Turning now to the figures, FIG. 1 illustrates a connector assembly 100. The connector assembly 100 is shown providing 2×3 array of bays, meaning it has two horizontal rows, one row stacked above the other row, and each row has three bays. It should be noted, however, that some other array configuration such as, without limitation, an array of 2×1, 2×2, 2×4 or 2×5 while using the features depicted herein. Thus, an array with a large number of bays ganged together is contemplated.

Figure 2:
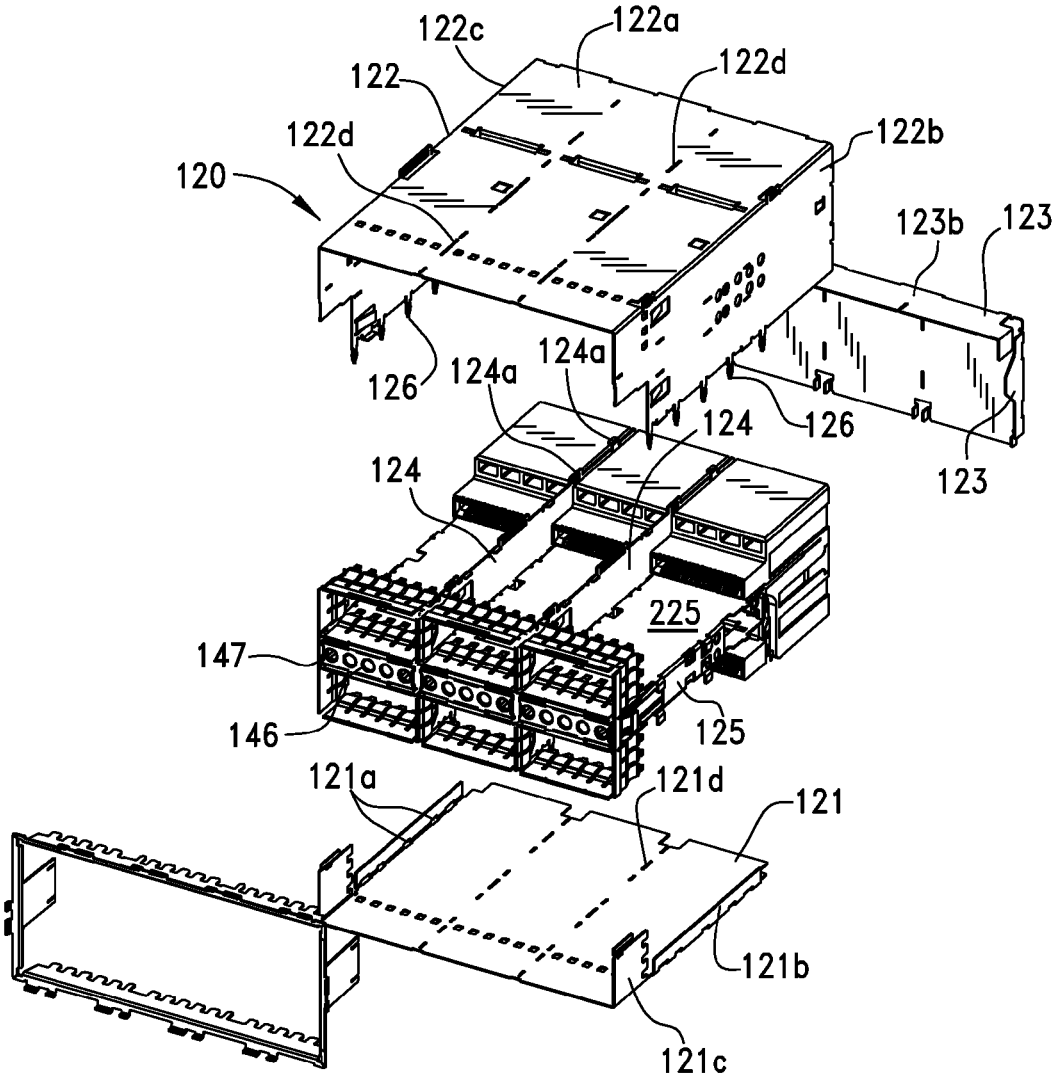
FIG. 2 is the same view as FIG. 1, but with the outer walls of the cage exploded to better illustrate the internal walls thereof.
Figure 3:
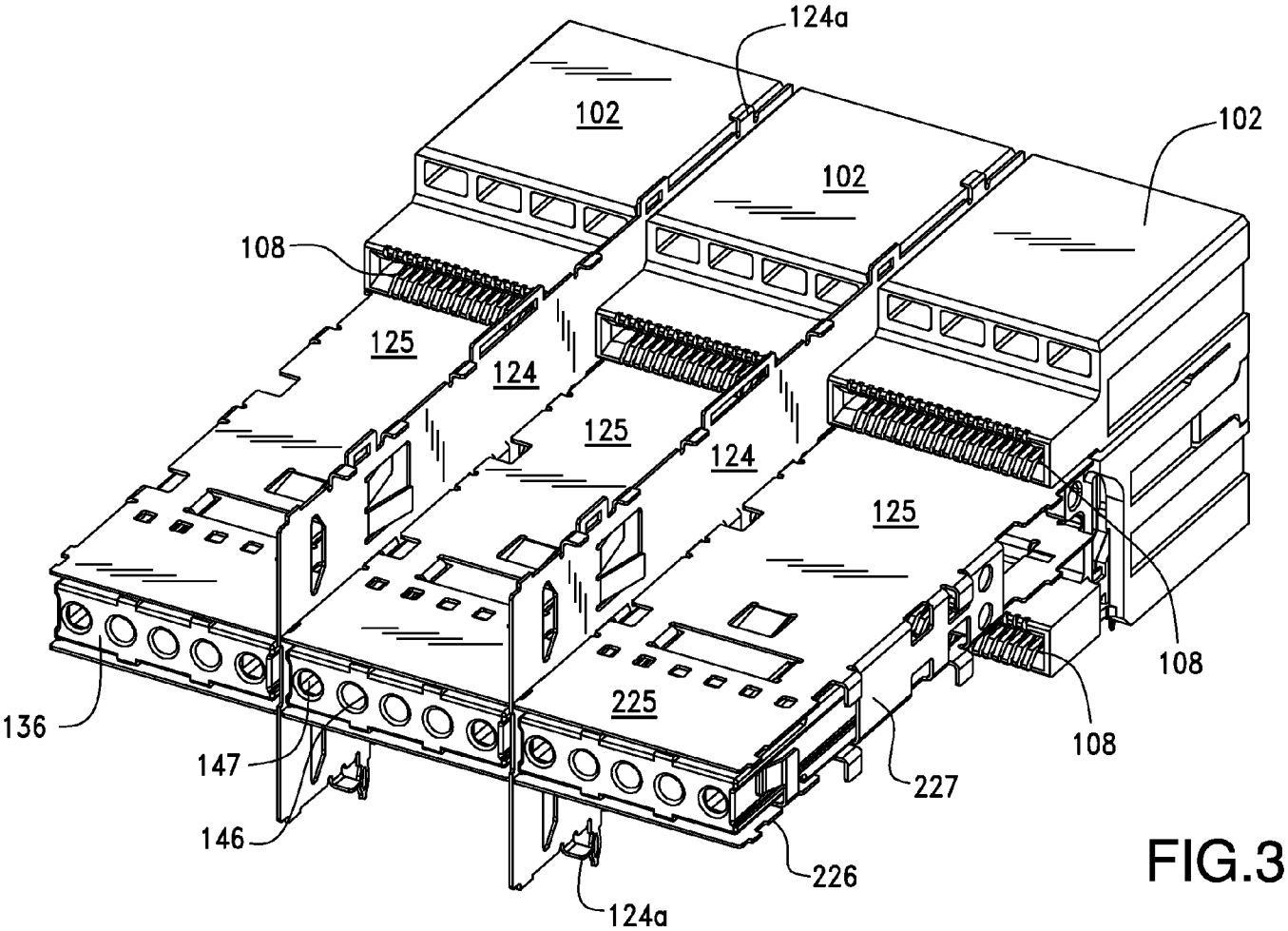
FIG. 3 is a perspective view of a connector-spacer assembly used in the cage-connector assembly of FIG. 1.

FIG. 2 illustrates an exploded view of the cage assembly of FIG. 1. As shown therein and in FIG. 4, three stacked housing 102 are accommodated within the connector assembly 100. As illustrated, each housing 102 is of a stacked QSFP (quad small form pluggable) configuration that encloses a plurality of terminal assemblies 106. As illustrated, each housing 102 has a first and second slot 108 (e.g., an upper and lower slot) that are configured to receive corresponding leading edges of circuit cards (not shown) that are supported by a plug connector, typically in the form of a metal module. The leading edge of the circuit card of the module projects inwardly and it is received with in the card-receiving slots 108 so as to make contact with terminals of the terminal assemblies 110 held within the connector housings 104. It should be noted that while the housing 102 is shown with a single slot, in an alternative embodiment a housing with two slots (such as provided in the CXP specification) could also be used.

In order to provide shielding against EMI, the connector assembly 100 also includes a cage 120 that encloses the housings 102 and which defines a plurality of bays 130, each of which is sized to receive a single electronic module therein. As used herein, herein, the term "module" is intended to be synonymous with "plug connector". As depicted, the number of bays 130 is equal to the number of card-receiving slots 108 in the connectors 102 of the assembly 100.

Returning to FIG. 2, the cage 120 is depicted as having a base member 121, a top member 122, a rear member 123, two divider walls 124 and a spacer 125. The base member 121, cover member 122 and rear member 123 cooperatively define wall that provide an enclosure which encloses the connectors 102 and defines an interior space of the assembly 100. This interior space is further divided into sub-spaces by each of the divider walls 124, with two such sub-spaces being defined on opposite sides of the divider wall 124. A front face 128 is positioned between an upper and lower bay 130*a*, 130*b* and the spacer 125 likewise serves to divide the interior sub-spaces into an upper and a lower bay 130*a*, 130*b* within each such sub-space.

The cover member 122 has three walls, a top wall 122*a* and two side walls 122*b*, 122*c*. The cover member 122 may include tail portions 126 in the form of compliant pins are formed as part of the cover member 122 and which are received within vias, or other openings on a circuit board so as to connect the cage to ground circuits on a circuit board. The tail portions 126 fit through slots 121*a* that are disposed in the base member 121. The base member 121 may include sidewall portions 121*b*, 121*c* that engage the cover member 122 to form a hollow enclosure. It should be noted, however, that the cage may omit the bottom wall in certain embodiments and could be formed of a single member, or any desired number of members, to form the cage that encloses the housings therein.

The rear member 123 of the cage 120 may also include sidewalls 123*a*, 123*b* that extend forwardly and engage the cover member 122. This rear member can be assembled onto the cover member 122 after the connectors 102 are inserted into the hollow enclosure formed by the cover and base members. Two divider walls 124 are shown in the illustrated embodiment that are provided to divide the hollow enclosure into three vertically-oriented sub-spaces, or compartments 129, that are arranged in side by side order. Each of these sub-spaces is further divided into two distinct bays 130 by the spacer 125 that extend transversely between the walls that form the compartment 129. In instances where only a single housing 102 is to be enclosed with a cage, no divider wall is used and one spacer 125 can be used and it would extend between the sidewalls 122*b*, 122*c* of the cage. In instances of a ganged connector assembly, such as the 2×3 ganged cage illustrated in FIGS. 1-4, two divider walls 124 are used and the cover and base member are divided into three compartments, each of which is divided into two bays by a spacer 125. The divider walls 124 may also include tails portions 126 formed therewith for connection to grounding circuits. In this embodiment, the center spacer 125 extends widthwise between the two divider walls 124, while the two outer spacers 125 extend widthwise between the divider walls 124 and the sidewalls 122*b*, 122*c* of the cage.

In order to facilitate assembly, the divider wall 124 may be formed with engagement tabs 124*a* and the like that are project outwardly therefrom and which are received in slots 122*d*, 121*a* that are disposed respectively in the cover member 122 and base member 121.

Figure 8:
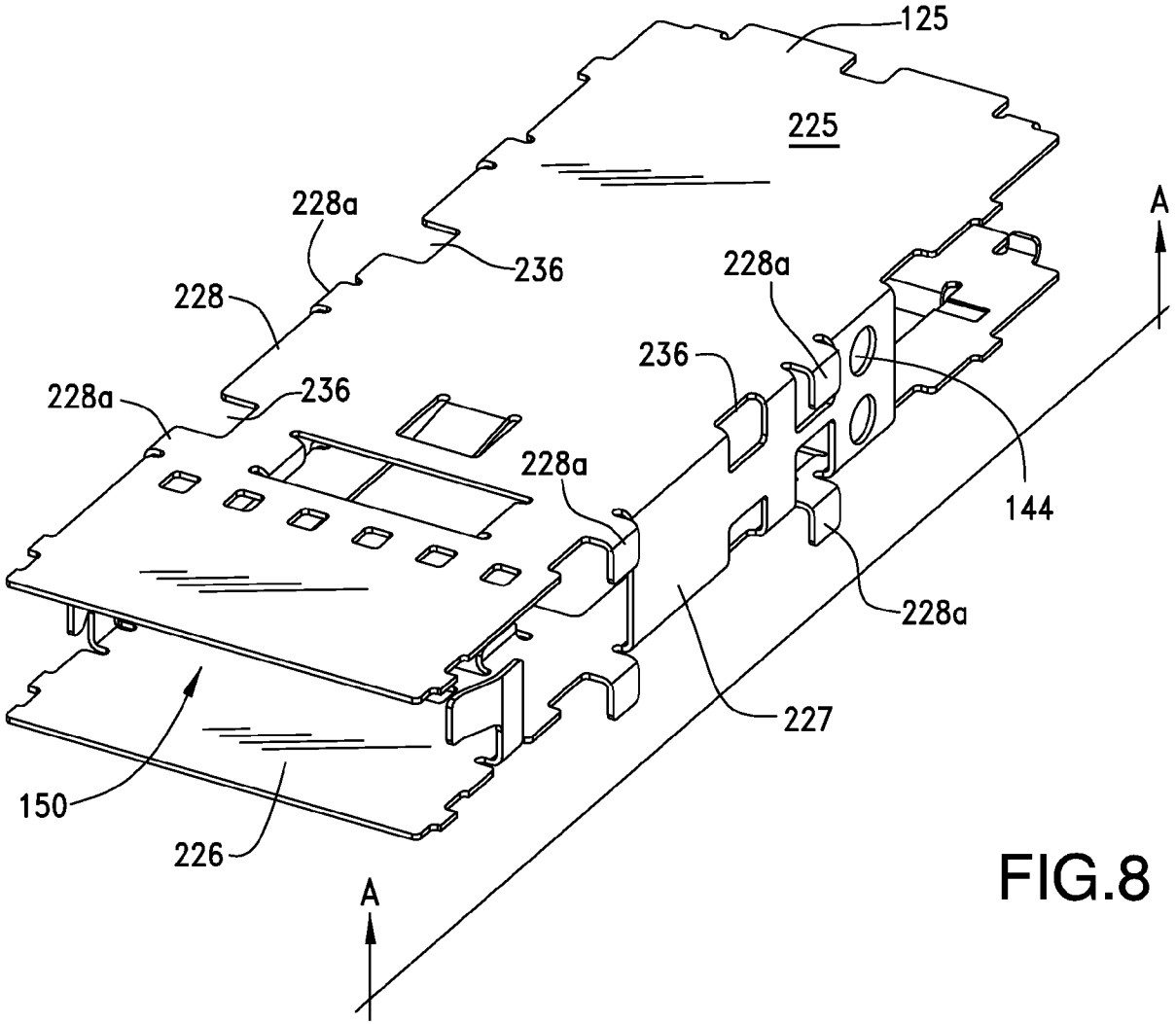
FIG. 8 is a perspective view of a spacer utilized in the cage assembly of FIG. 5.
Figure 8A:
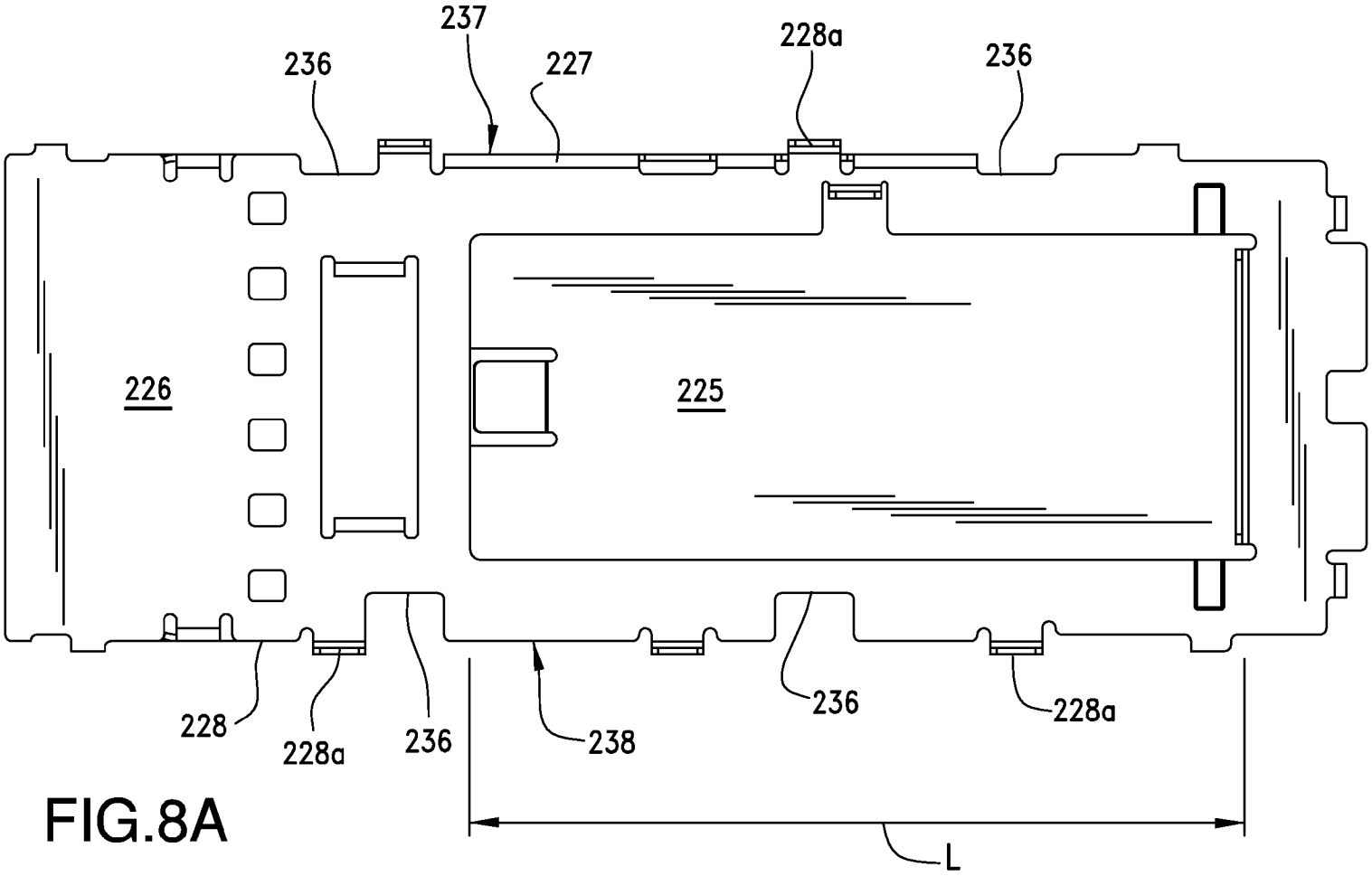
FIG. 8A is a bottom plan view of the spacer of FIG. 8, as viewed from line A-A thereof.
Figure 8B:
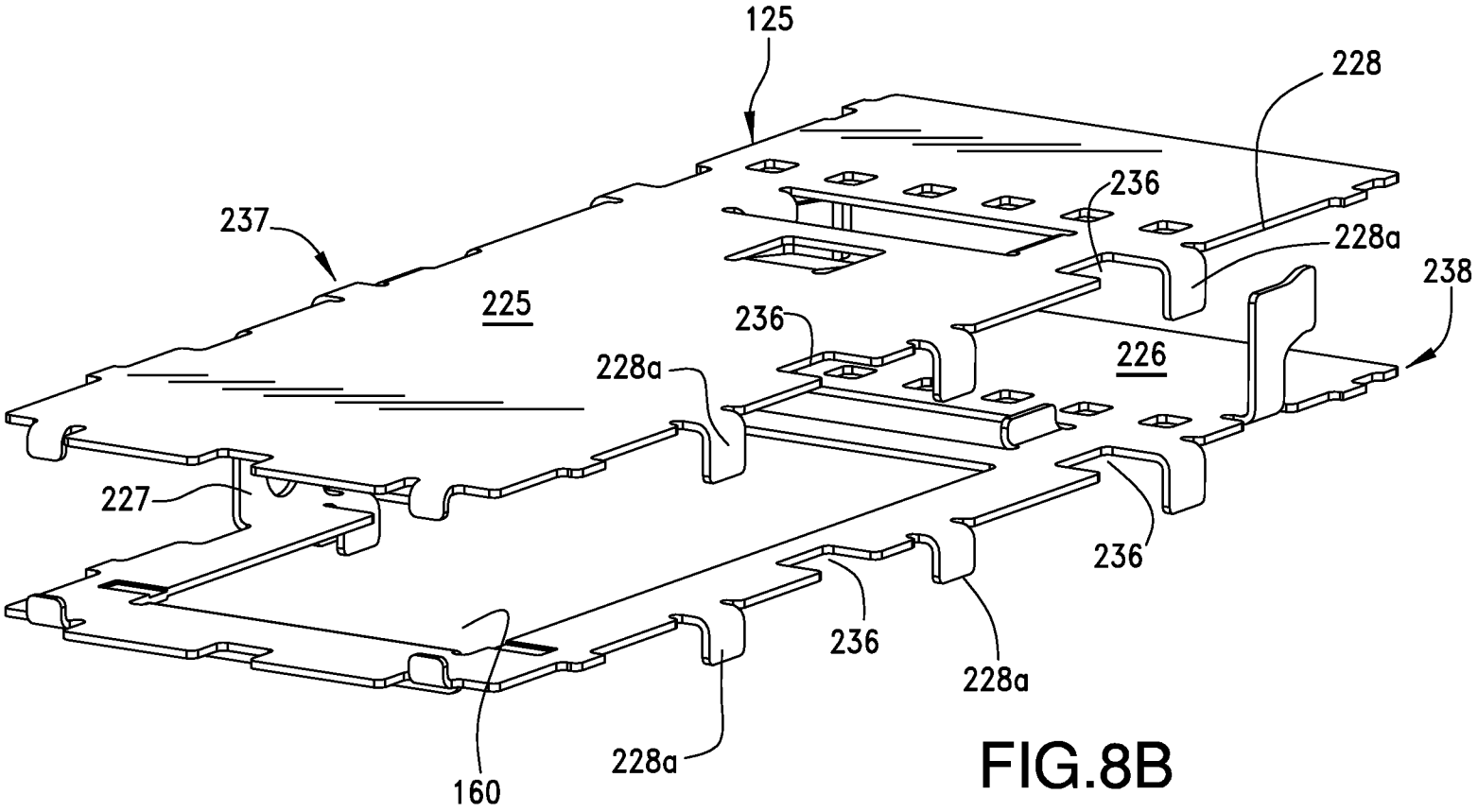
FIG. 8B is a perspective view of the spacer of FIG. 8, taken from the opposite side thereof.
Figure 8C:
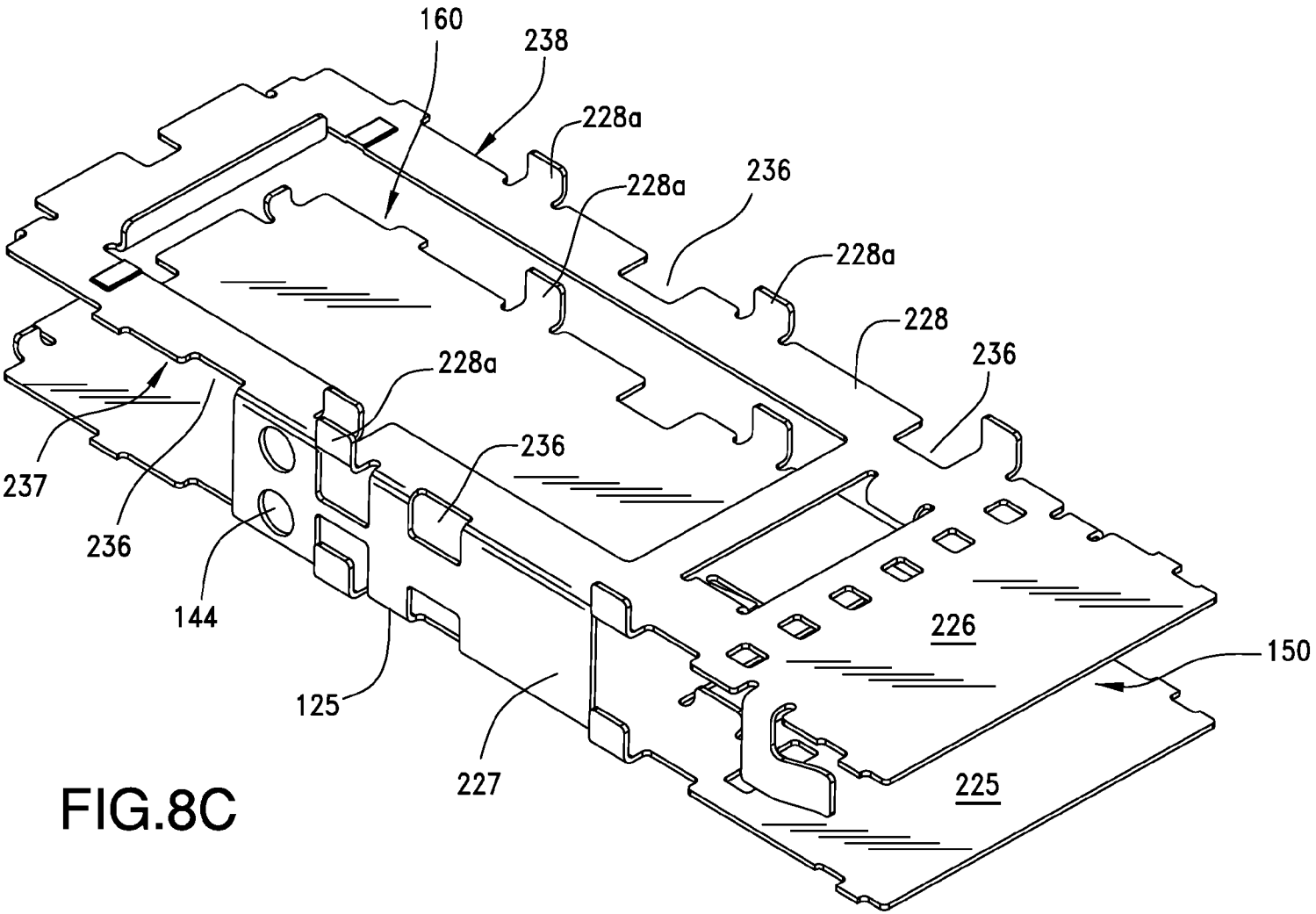
FIG. 8C is a perspective view of the space member of FIG. 8, but taken from a reverse angle thereof.
Figure 8D:
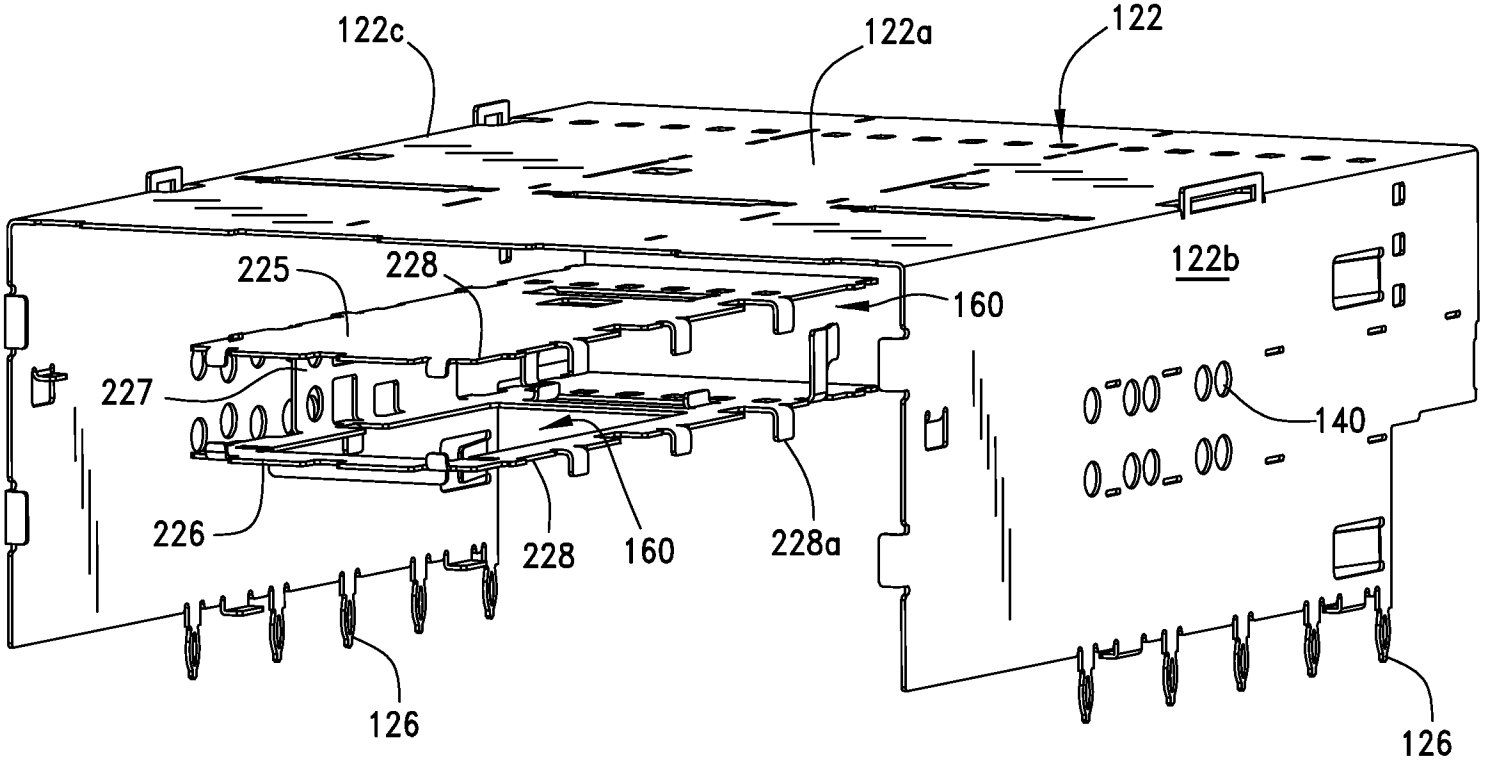
FIG. 8D is a perspective view of the cage outer wall member with the spacer positioned therein.

As depicted in FIG. 8, the spacer 125 has a generally U-shaped configuration with a top wall 225, a bottom wall 226 and a sidewall portion 227. As can be appreciated, however, the spacer could also be a two piece design with separate top and bottom walls. As shown in FIG. 8D, the top and bottom portions 225, 226 terminate in free ends 228 on the side opposite the side wall portion 227. Each free end 228 may include one or more engagement tabs 228*a* that engage the divider walls 124 via slots (not shown) and also preferably engage an adjacent spacer. The spacer top wall 225 serves to define a floor, or bottom, of the upper module-receiving bays 130*a* of the cage, while the bottom wall 226 of the spacer 125 serves to define the ceiling of the lower module-receiving bays of the cage.

As is known in the art of SFP type connectors, each bay 130 receives a plug connector in the form of an electronic "pluggable module" that is inserted into the bay from the front of the connector assembly 100. The pluggable module typically includes a circuit card projecting form a free end that is received within the connector card-receiving slots 108 so that the terminals 110 of the terminal assemblies engage and connect to contact pads disposed on the circuit card, preferably along its leading edge.

During high speed data transmission, the connectors and modules generate heat. Excessive heat can be harmful to electronic components so operators seek to control the heat generated by operation of routers and sensors using these connectors and modules and dissipating it. One solution is attaching heat sinks to the modules themselves. However, this would necessitate removing part or a substantial portion of the cage cover member 122. Making an opening in the cover member 122 could eliminate a large portion of the EMI shielding capability of the cage for the upper module-receiving bay. However, even utilizing a heat sink in such a manner would not provide a solution to heat dissipation for the lower module inasmuch as the module in the lower module-receiving bay 130*b* could not be contacted by the heat sink. Due to its location and the fact the cage is mounted to a circuit board, it is impractical to attach a heat sink to the bottom module.

In order to help overcome this problem, air flow through a central portion of the connector can be beneficial. In an embodiment, a connector utilizes a network of air flow openings arranged in the connector assembly 100 that cooperatively provide a cooling network of passages that are disposed throughout the connector assembly 100 in proximity to the modules in both the upper and lower bay 130*a*, 130*b*. As shown in FIG. 2, the connector assembly 100 has a plurality of openings 140 that are formed in the sidewalls of the cage cover member 122. These openings 140 are shown in an array of two horizontal rows 141*a*, 141*b*. The rows 141*a*, 141*b* of openings 140 are aligned with a center portion 232 defined by the spacer 125 (e.g., the intervening area between its top and bottom walls, 225, 226 that separates the upper and lower bays 130*a*, 130*b*) so that either due to an air pressure differential pressure, such as that caused by a cooling fan, or by ordinary convention, air can traverse the center portion of the connector assembly 100 and the air can help cool any modules positioned therein.

Figure 7:
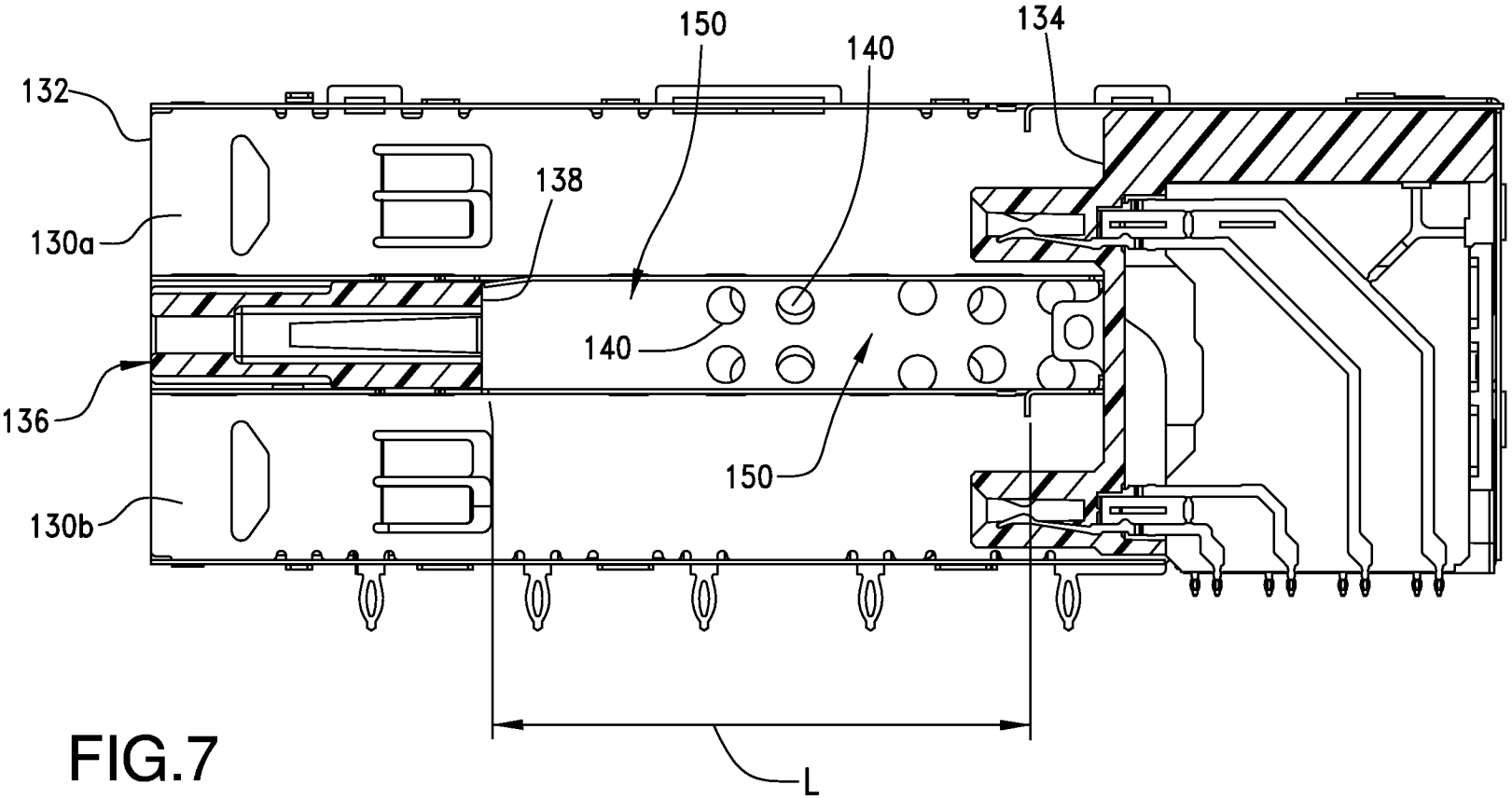
FIG. 7 is a side elevational view of the open section of FIG. 6.

The center portion 232 extends lengthwise of the connector assembly 100 from the front openings 132 of the bays 130 to the front face of the connectors 102, as well as widthwise between adjacent divider walls 124 or divider walls 124 and the side walls 122*b*, 122*c* and thus provides an air flow passage 150 through the middle of the connector assembly. The openings 140 in the side walls and/or the divider walls communicate with this air flow passage 150 and provide a means for either conventional convection cooling or forced air cooling due to an air pressure differential. As shown in FIG. 7, the openings 140 are preferably disposed in a pattern (two rows) so that they lie within the boundaries of the air flow passage 150 shown in FIG. 7. These boundaries are the top and bottom walls 225, 226 of the spacer 125 and the front face 134 of the housing 102 and the rear face 138 of the insert 136. The openings 140 may further be aligned with each other as between adjacent divider walls and/or the side walls, meaning that for every air flow passage 150, an opening 140 in the right hand wall thereof is aligned, widthwise with an opening 140 in the left hand wall of the air flow passage 150, as shown along line AR in FIG. 9.

In order to preserve the amount of space available for the openings 140, the spacer 125 can be provided with its own openings 144 and these openings can be disposed in the side member 227 of the spacer 125. Although it is preferred that the spacer openings 144 are substantially matched (or aligned) with the openings 140 of the side or divider walls, 122*b*, 122*c*, 124, such alignment is not required and there may be a certain amount of offset, as is illustrated in FIG. 7. Generally speaking, matching the openings tends to reduce the resistance to air flow and therefore tends to allow sufficient thermal energy to be transferred out of the connector with less pressure differential.

Figure 4:
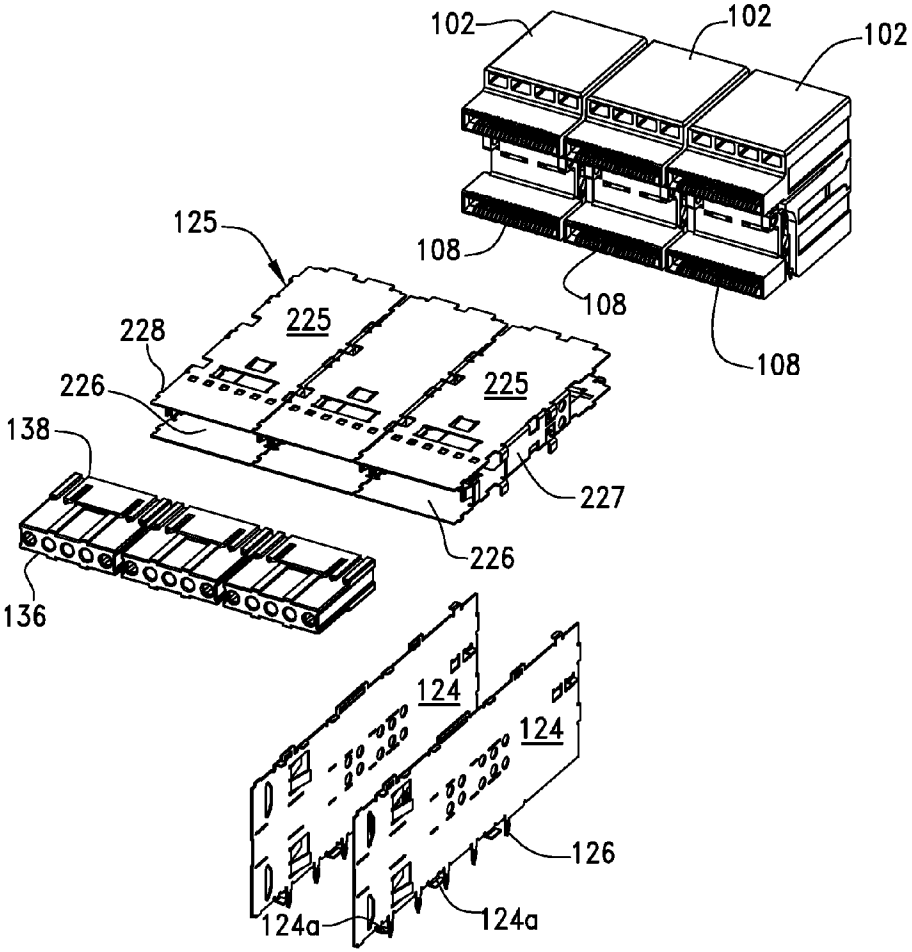
FIG. 4 is an exploded view of FIG. 3.
Figure 5:
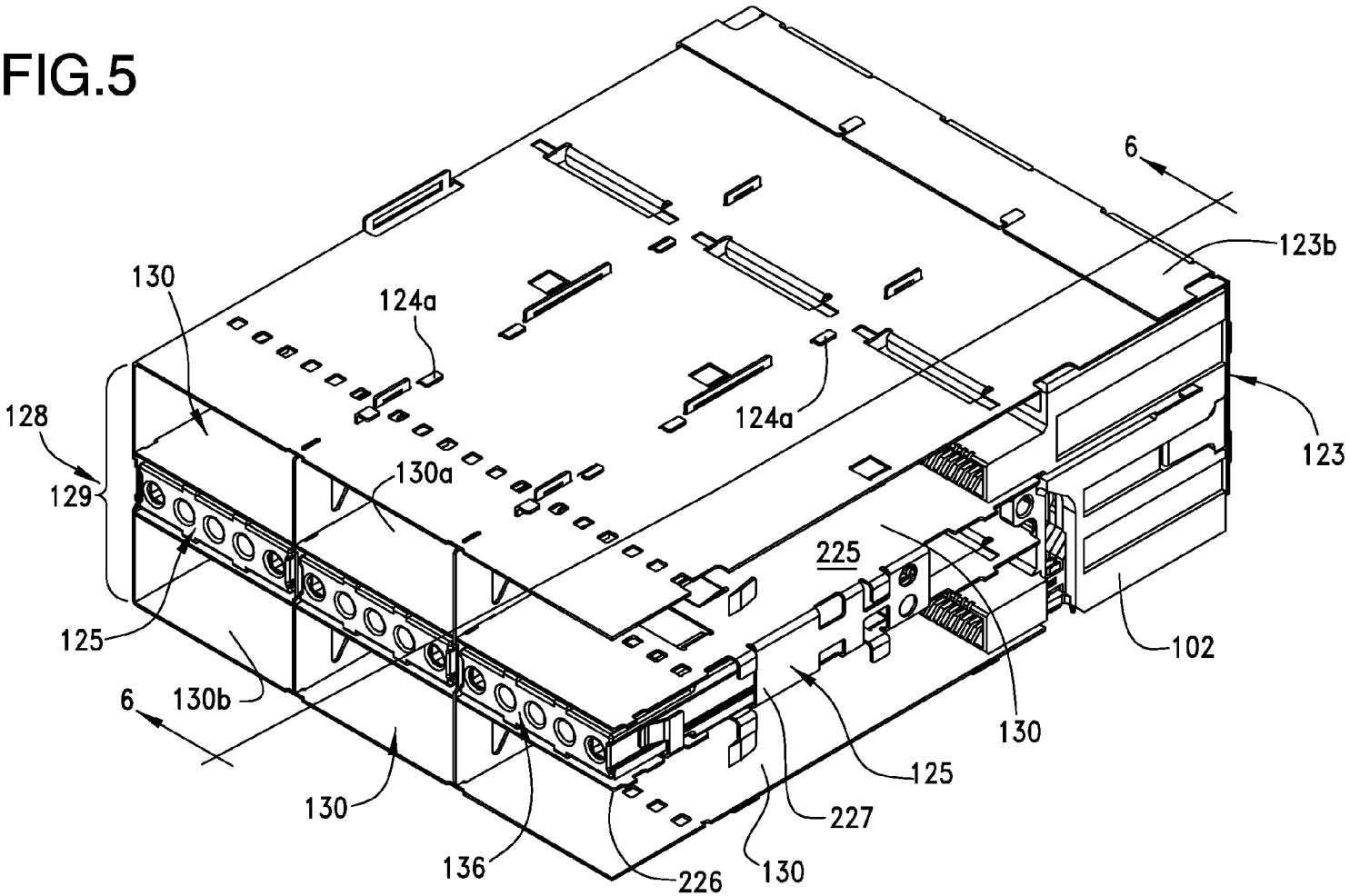
FIG. 5 is a sectioned view of FIG. 1, taken along line 5-5 thereof with the front EMI collar and gaskets removed for clarity.
Figure 6:
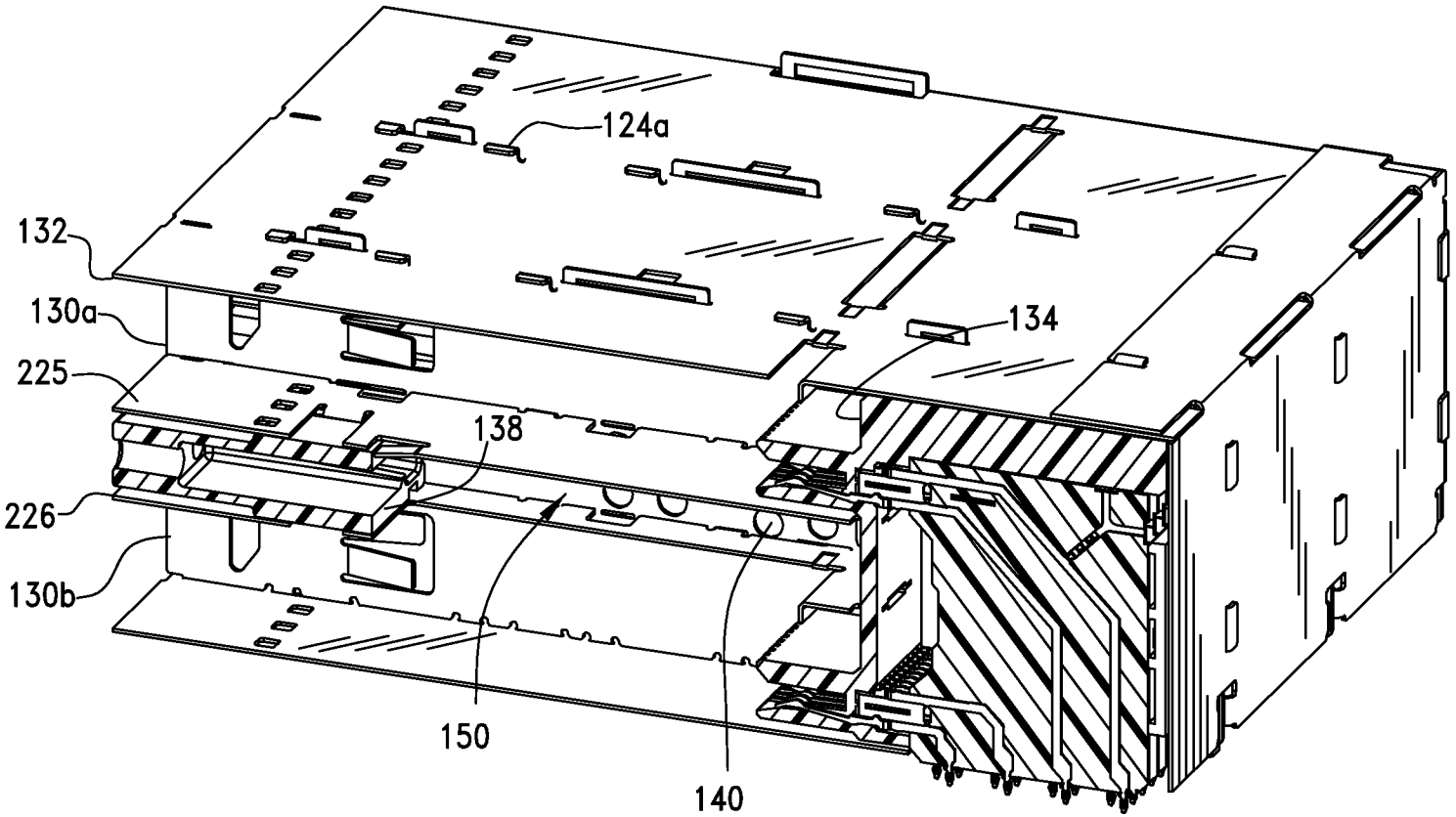
FIG. 6 is a sectional view of the cage-connector assembly of FIG. 5, taken along line 6-6 thereof.
Figure 9:
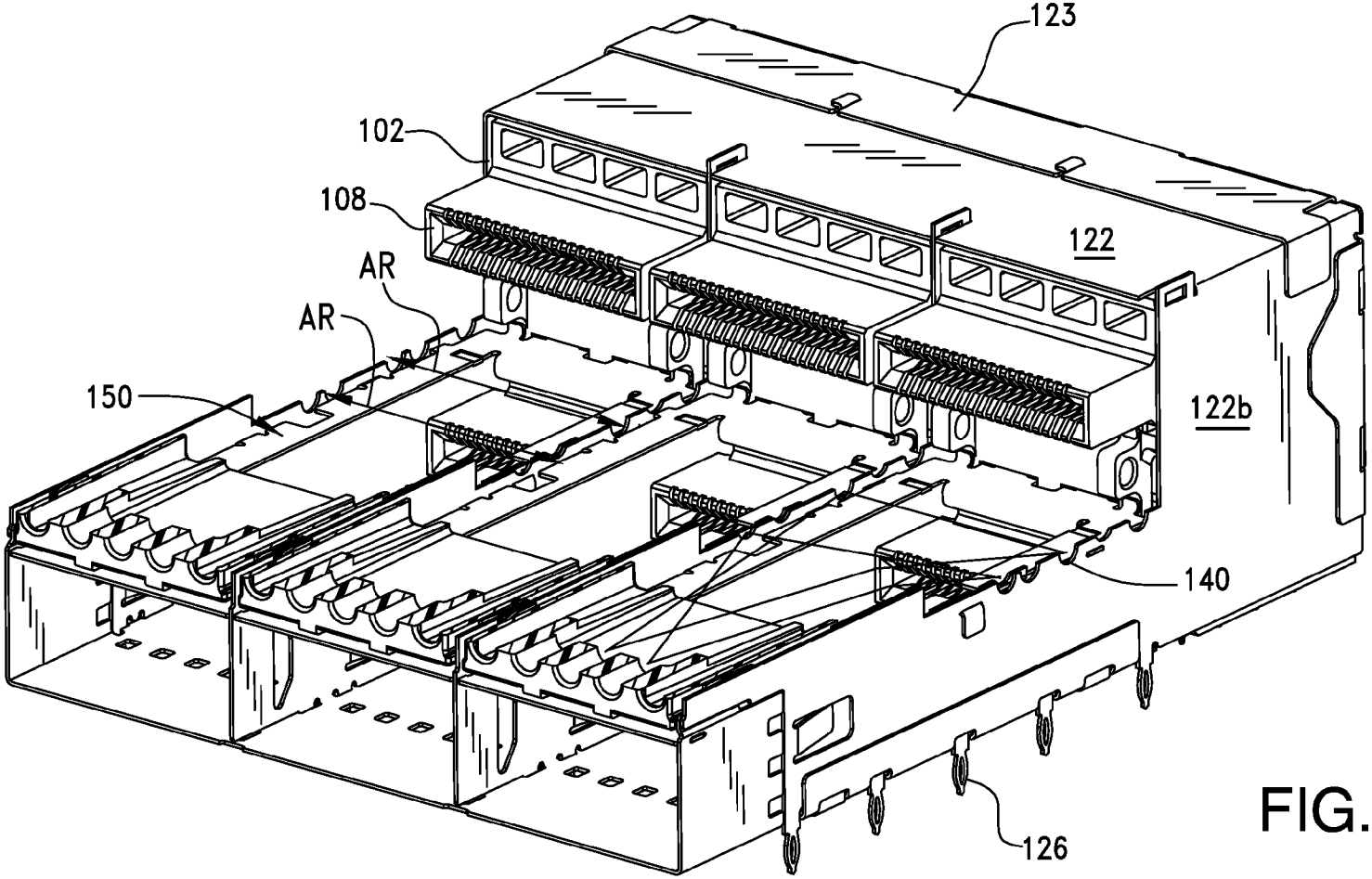
FIG. 9 is a sectioned perspective view of the connector assembly of FIG. 1, with the outer cage sectioned through the spacer to eliminate the open air flow opening in the bottom of the spacer.
Figure 10:
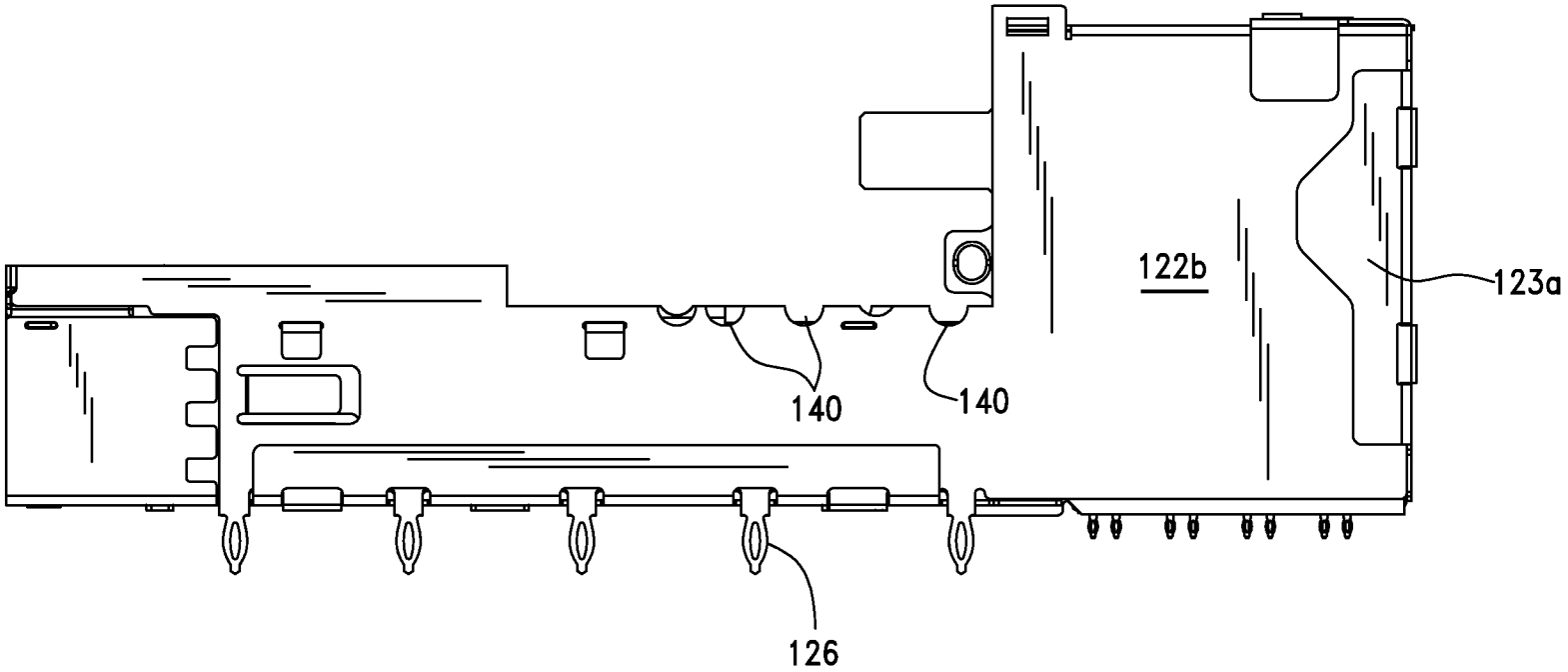
FIG. 10 is a side elevational view of the sectioned assembly of FIG. 9.
Figure 11:
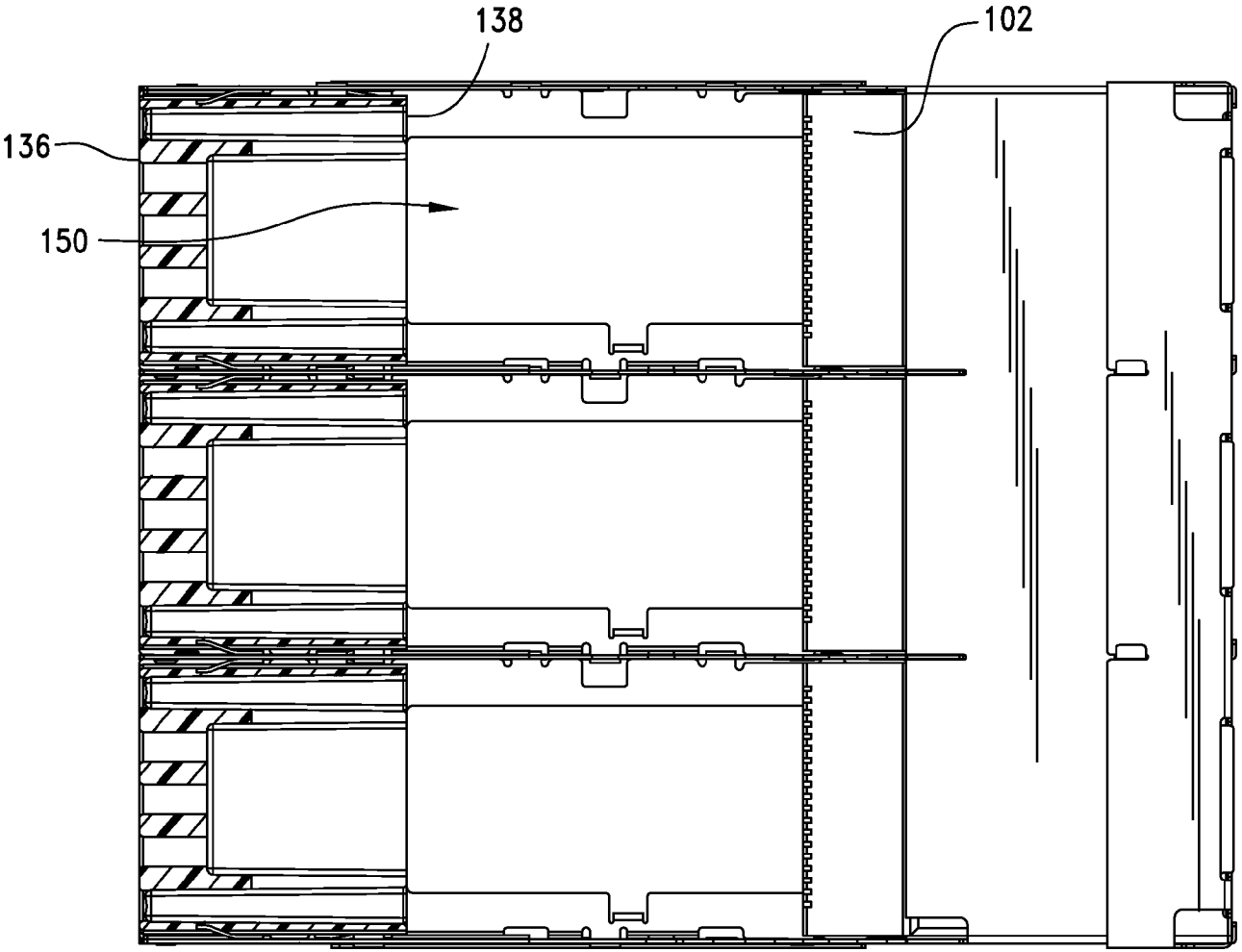
FIG. 11 is a top plan view of the sectioned assembly of FIG. 9.

An insert 136 may be provided for use with each housing 102 (if, for example, the front face 128 is not integrated into the spacer) and as such, the insert 136 is preferably dimensioned to fit within the air flow passage 150 at the front end, or entrance 132, of each module-receiving bay 130 of the connector assembly 100. The insert 136 may be formed of a conductive material such as a die-cast metal or it may be a plastic resin that is plated with a conductive materials. As shown in FIGS. 4-6, the insert 136 has a plurality of openings 146 that extend lengthwise through it, i.e., from front to back, and these openings 146 may accommodate fastening elements, such as screws 147 or the ends of light pipes that may run the length of the air flow passages 150 to indicate a status condition of the electronic modules and connectors. At least one of the openings 146 is provided in the insert 136 for use as an front air opening and, as such, it communicates with both the air flow passage 150 and the exterior of the connector assembly 100, and it is preferred that two or more such openings 146 are utilized for each insert 136. In general, it has been determined that the percentage of opening provided by the front opening(s) in the front face 128 can be greater than 10 percent of the total area of the front face. If two or more apertures are used, then the sum of their areas can be compared. Naturally, the front opening could also be provided by a single opening, however this could negatively affect EMI performance so testing would be useful to determine whether the particular system benefited more from a single larger opening or a plurality of smaller openings. As positioned, each insert opening 146 is transversely spaced apart from any pair of air openings 140 of the side walls 122*b*, 122*c*, divider walls 124 or spacers 125. Furthermore, any one insert opening 146 and any two side openings 140 of the air flow passage 150 are arranged at the vertices of imaginary triangles, as shown in FIG. 9. ence they collectively may be considered as defining a torturous path for air to circulate within the connector assembly 100.

The electronic module that will be received within the top module-receiving bay will tend to lie flat on the floor of the bay (i.e., the top wall of the spacer 125) and so make direct contact therewith. Heat may then be transferred form the electronic module directly to the cage by conduction. The openings formed in the cage and communicating with the air flow passage 150 will permit the flow of air through this area, which in turn will the thermal energy conducted to the cage to be removed by convection cooling.

In order to provide cooling for the modules received within the bottom module-receiving bays 130*b*, the bottom wall 226 of the spacer 125 can have a large opening 160 formed therein. As best illustrated in FIGS. 8C & 9, this opening 160 can be rectangular in configuration and it extends lengthwise along the spacer bottom wall 226 between the front face 134 the housing 102 and the rear face 138 of the insert 136 for a distance L. In an embodiment, the pattern of air flow openings 140 in the side and divider walls and spacer side may be arranged so that at least 75% of them are aligned with the large opening 160 and are positioned within the boundaries of L so that air passing therethrough can communicate with and enter the opening. In an embodiment, the length L of the opening 160 may be at least 50% of the length of the electronic module received within the bays 130 so as to ensure adequate air flow over the bottom module. The value of L may also be at least 50% of the length of the bay 130. As can be appreciated, the area of the opening 160 can ready be greater than 25% of the area defined by the bottom wall 226 and in certain embodiments can be greater than 33% or even greater than 40% if more cooling is desired. One benefit of this structure occurs when a negative air pressure draws air through the device in which the cage assembly is used, air heated by a module in the bottom bay 130*b* will rise up through the opening 160 in the bottom wall 226 of the spacer 125 into the air flow passage 150, where it can be drawn off by an exterior means such as a fan of the like. Thus, this helps improve the efficiency of the system for cooling the lower module, which normally is more difficult to cool.

Figure 12:
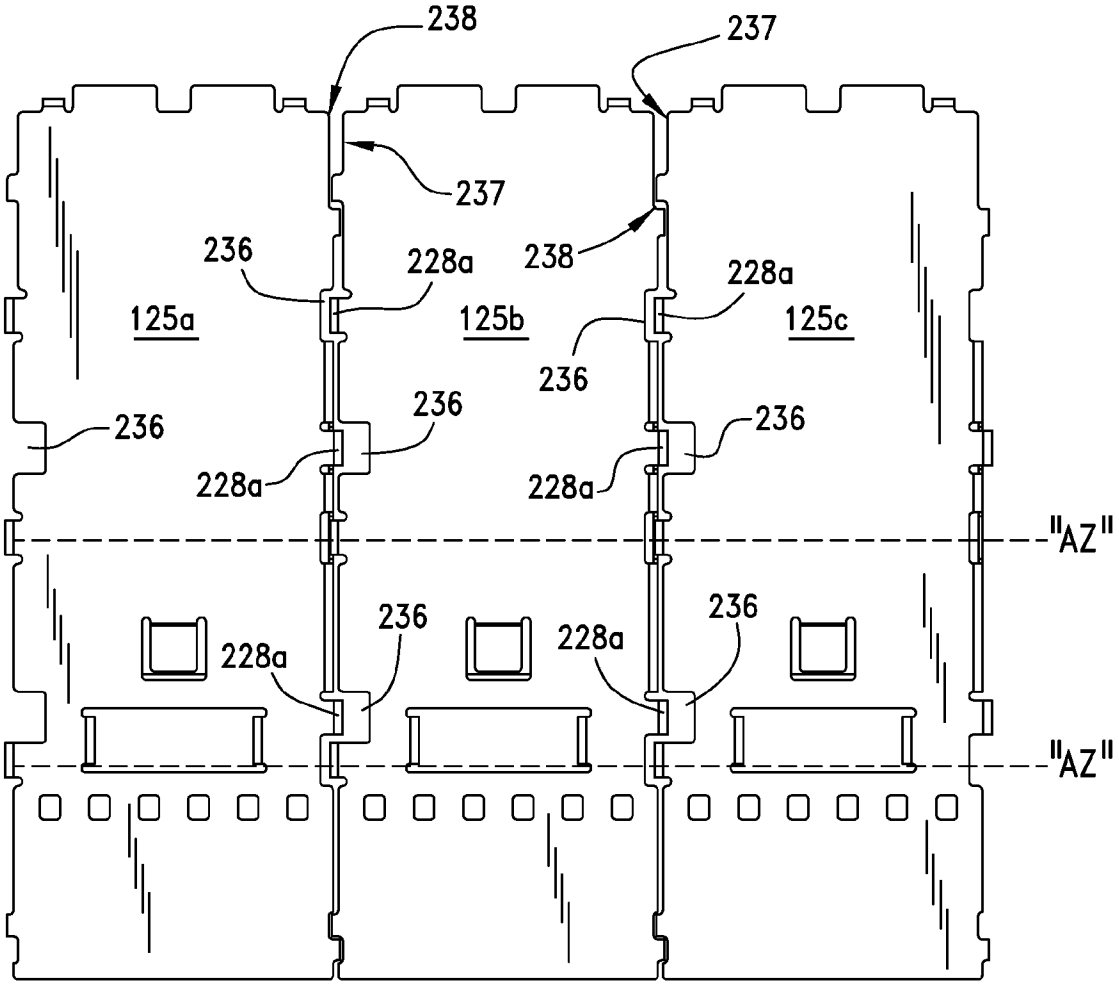
FIG. 12 is a top plan view of the spacers of FIG. 4, illustrating the interaction between their engagement tabs and their clearance slots.

As mentioned above, the spacer 125 is provided with a plurality of engagement tabs 228*a* that project outwardly therefrom and which are used to engage any one of the upstanding walls. In order that the spacers 125 may be used adjacent each other in ganged cage applications, the opposing edges 237, 238 of the spacer 125 are patterned in an alternating pattern of engagement tabs 228*a* and clearance slots 236. For every engagement tab 228*a* present on one edge 237 of the spacer 125, there is a notch, or clearance slot 236 disposed on the opposing edge 238 of the spacer 125. These engagement tab-clearance slot combinations are aligned with each other widthwise with respect to the spacer 125. This relationship is best illustrated in FIG. 12, which is a top plan view of an array of these spacers 125*a*, 125*b* and 125*c*. It can be seen in FIG. 12 that these combinations are along a series of parallel axes AZ. This is so only one spacer 125 need be manufactured and yet can be used in either singular or ganged applications.

Figure 13:
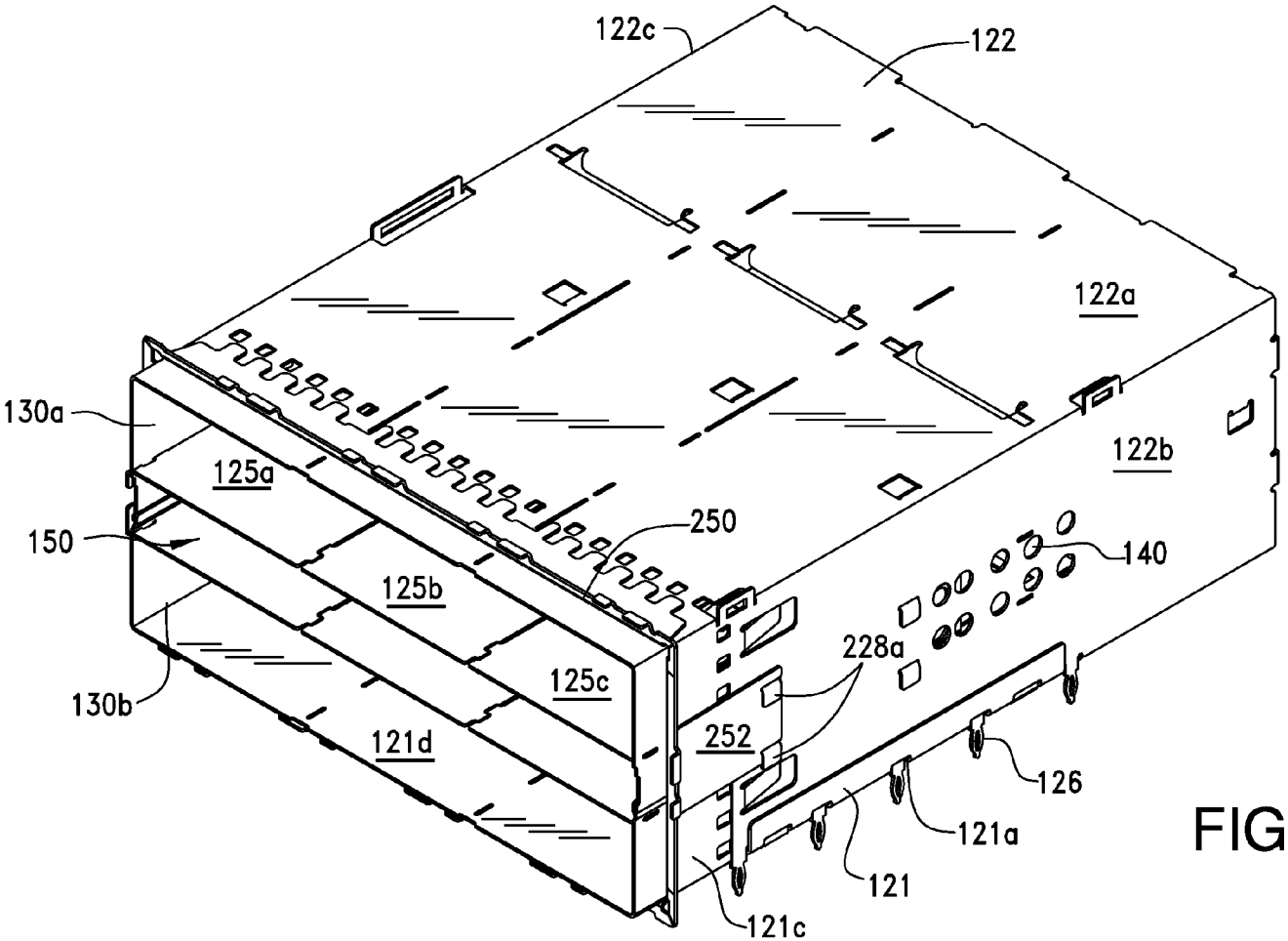
FIG. 13 is the same view as FIG. but with the endcaps and EMI gaskets removed for clarity to better illustrate the engagement between the outer collar and the cage.

With the slots opposing the engagement tabs, they fit into the clearance slots when folded over an divider wall 124 so that the spacers 125 can be arranged in a pattern close to each other and be separated only by the thickness of the intervening, divider wall 124. In this manner, and as illustrated in FIGS. 2 & 13, the spacers 125*a*, 125*b*, & 125*c* can be easily arranged in a horizontal line that extends transversely between the sidewalls 122*b*, 122*c* of the outer shell, i.e., widthwise of the connector assembly 100. This assists in keeping the overall height of the assembly 100 down to a desired dimension.

Figure 14:
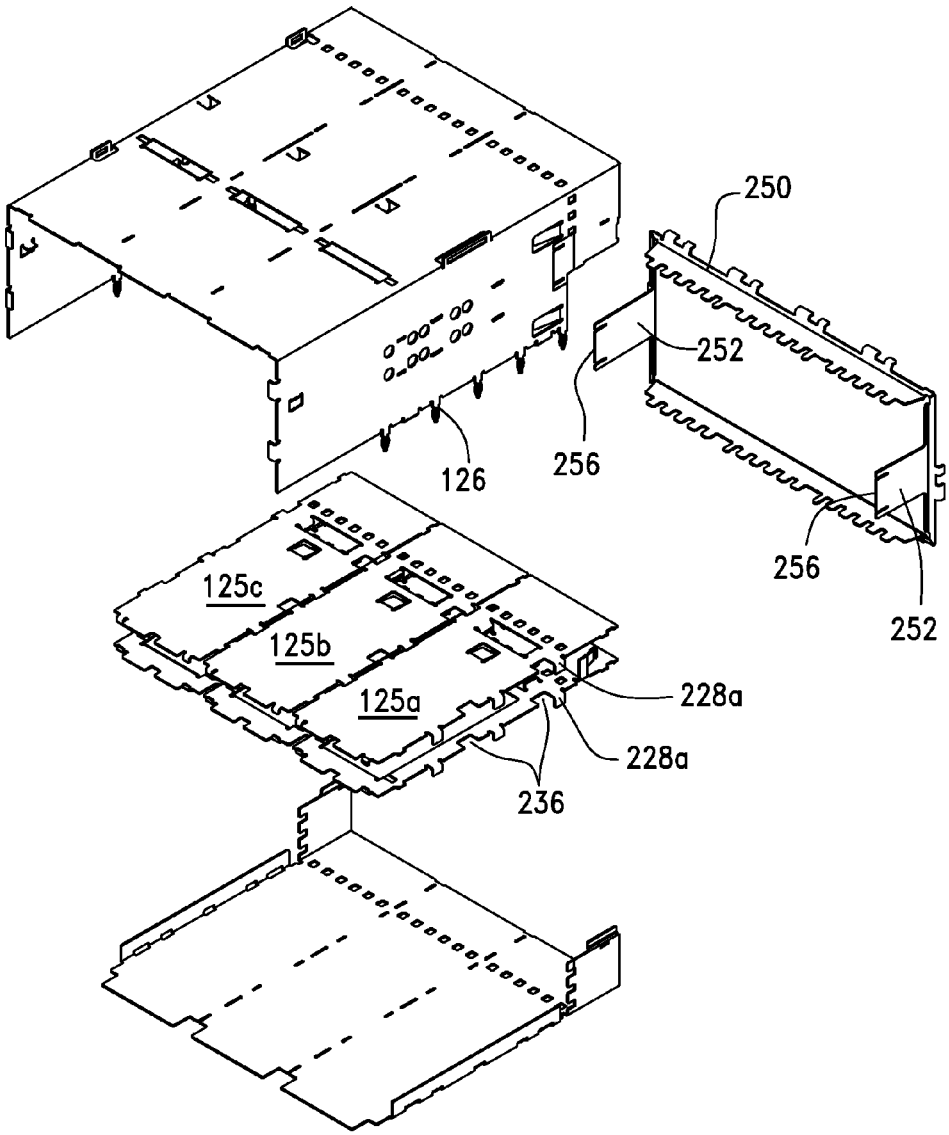
FIG. 14 is an exploded view of the cage of FIG. 13 taken from the opposite side for clarity.

As shown in FIGS. 13 & 14, the cage assemblies may also include an exterior collar 250 that fits around the front of the cage assembly proximate to the front openings thereof. This collar 250 acts as a frame to support an exterior EMI gasket (not shown) that fits between the cage assembly and a faceplate of a structure in which the cage assembly is mounted. To facilitate the assembly of the connector assembly 100, the collar 250 has a pair of engagement tabs or flanges 252 formed on its sides which extend rearwardly. The collar 250 serves to hold the cover member 122 and the base member in engagement at the front of the assembly 100. The collar can also retained in part by the spacers 125. Particularly, the spacers 125 can have their forward engagement tabs 228*a* extend through slots in the side walls 122*b*, 122*c* and these tabs 228*a* are also received in slots 254 formed in the trailing edge 256 of the flanges 252 so as to hold the collar 250 in place.

Figure 15:
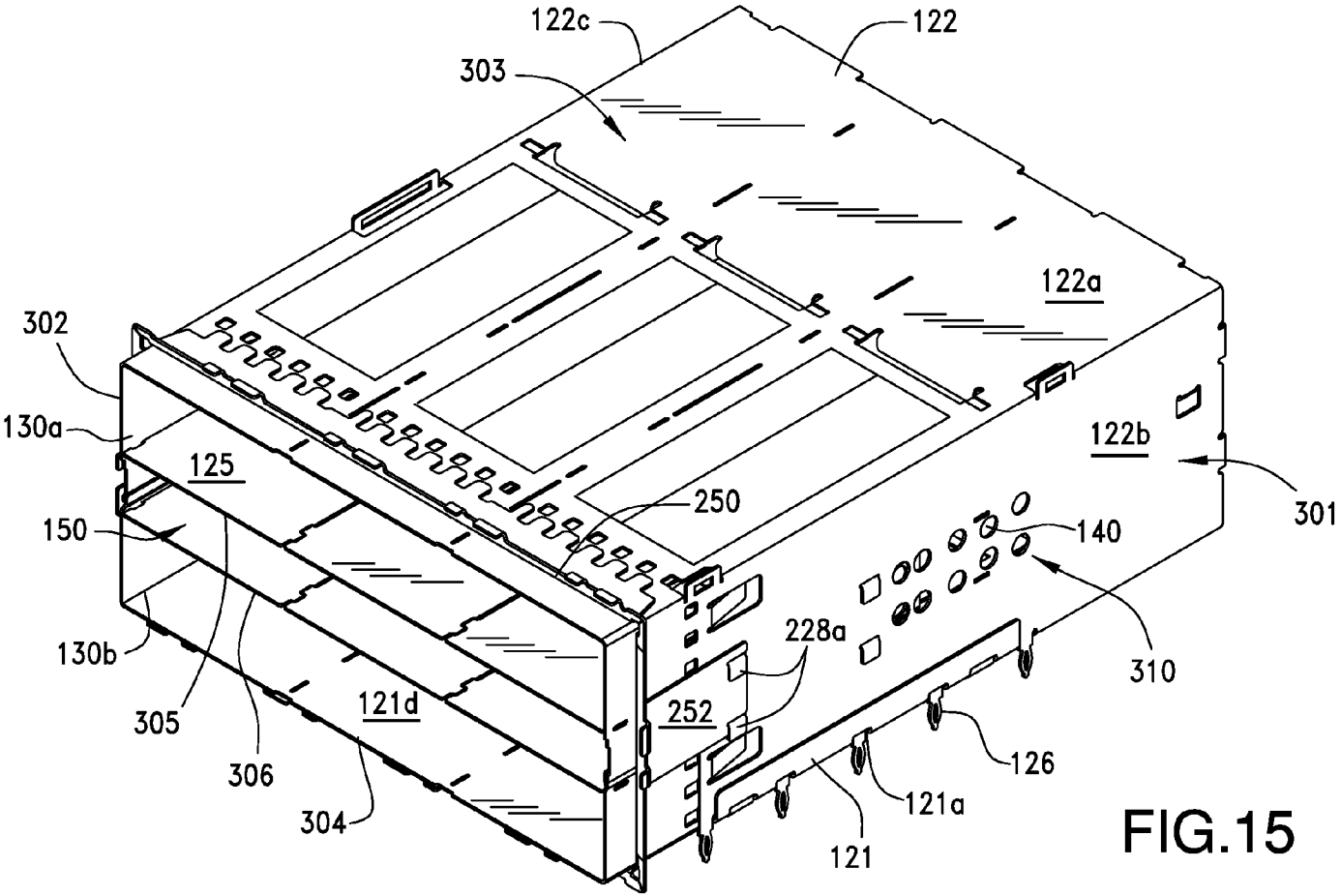
FIG. 15 illustrates a perspective partial view of an alternative embodiment of a connector.
Figure 16:
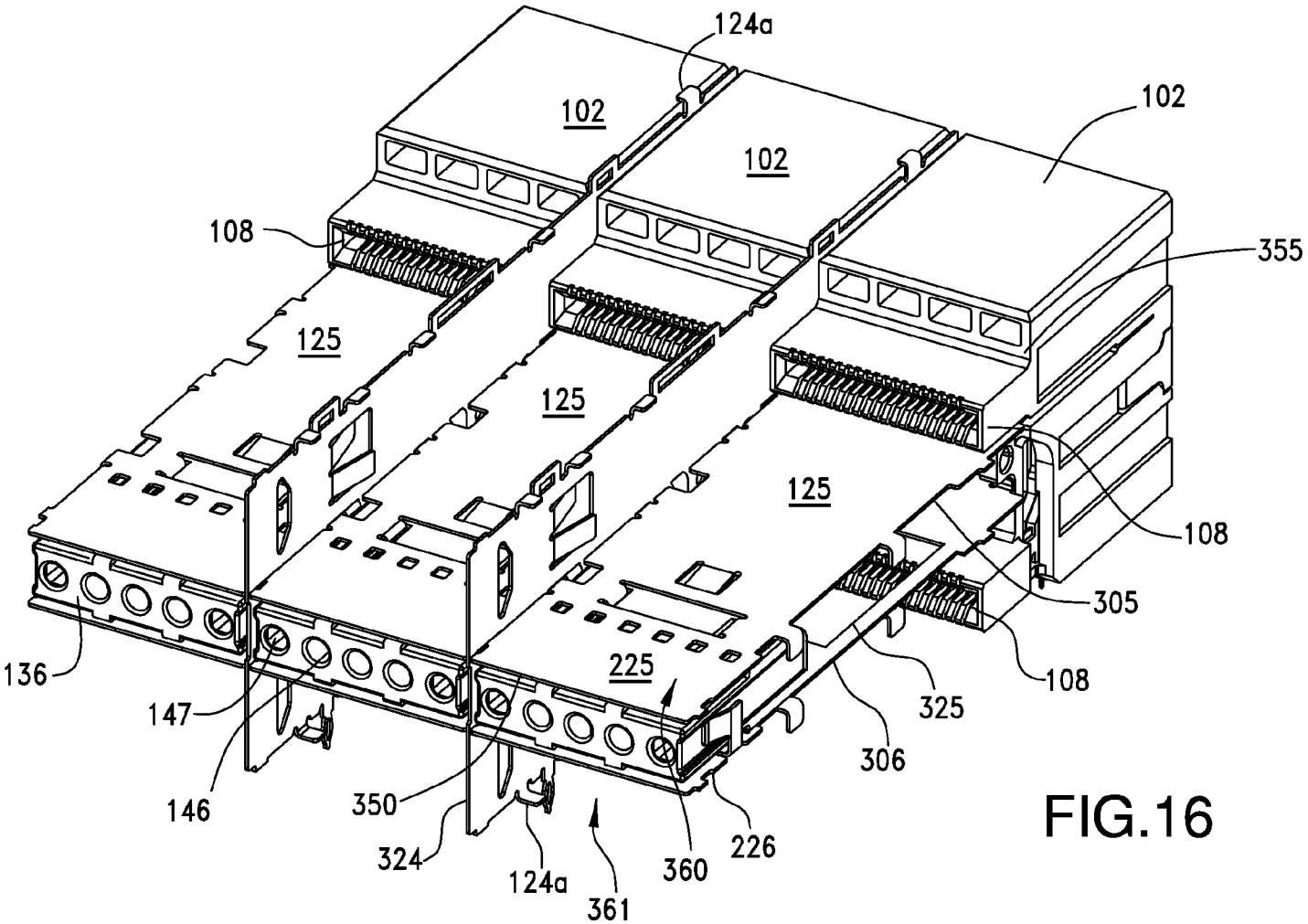
FIG. 16 illustrates a perspective partial view of additional features of the connector depicted in FIG. 15.

FIGS. 15 and 16 illustrate another embodiment of a connector. As can be appreciated, a first wall 301 and a second wall 302 are provided and a third wall 303 extends therebetween, thus forming a top wall that extends between two side walls. While not depicted in this view, as depicted in FIG. 1, for example, a fourth wall (which would be a rear wall) may also be provided and such a rear wall helps ensure good EMI shielding.

A fifth wall 305 and sixth wall 306 are spaced apart and in conjunction with spacer wall 324, form a first channel 360 and a second channel 361 that are separated by the space between the fifth and sixth wall 350, 306. As can be appreciated from FIGS. 15 and 16, however, the fifth and sixth wall are separately pieces and are separately supported by the spacer wall 324 and/or the first or second wall 301, 302. Thus, the configuration of walls and the method of manufacture is not intended to be limiting unless otherwise noted.

As can be appreciated, from FIGS. 15 and 16, therefore, air passes through openings 146 in the insert 136, over the aperture 325 and then out side apertures 310. The openings form a triangular relationship with one opening being positioned in an insert (which can be formed of an insulative or conductive material). In addition, as noted above, the insert may include one or more openings configured to transmit light received from a light pipe, not shown. It should further be noted that the openings in the insert may be modified as desired and in an embodiment could be a single slot. To provide good EMI shielding and ensure air flows through the air passage way in a desirable manner, however, the side aperture is preferably formed of a number of smaller apertures that are positioned more than 30 percent of the channel length from the front of the cage, where the channel length is the distance between edge 350 of the channel opening and support surface 355 of the housing 102.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. A connector, comprising:

a cage with a front face, the cage including a top wall, a first and second side wall and a rear wall, the wall cooperatively forming a hollow interior space;

a housing with at least a first card slot and at least a second card slot positioned in the hollow interior space, the at least first car slot and at least second card slot vertically spaced apart;

a first spacer positioned between the first and second side wall and between the at least first card slot and at least second card slot so as to define a first and second bay, the first spacer defining a central portion between the first and second bay, the central portion having a length that extend from the front face to the housing; and a first front face aligned with the central portion, the first front face including at least one front aperture that is in communication with the central portion, wherein the first and second side wall each have a plurality of side apertures in communication with the central portion so as to allow air to flow through the at least one front aperture, along the central portion and out the side apertures, wherein the side apertures are positioned at least one third of the length of the central portion from the first front face so that there are no side apertures closer to the front face than one third of the length.

2. The connector of claim 1, wherein the front face is provided by an insert, the insert including a plurality of apertures configured to allow air to flow past the insert.

3. The connector of claim 2, wherein the insert has a front face with a first area and the at least one aperture defines a second area that is at least 10 percent of the first area.

4. The connector of claim 1, wherein the first wall is a divider wall and the housing is a first housing, the cage further including a third side wall such that the first wall is positioned between the second and third wall, the third side wall having side apertures, the connector further including:

a second housing positioned between the third and first wall;

a second spacer positioned between the third and first wall to define a central portion between a third and fourth bay; and a second front face positioned between a third and fourth bay, the second front face including at least one aperture in communication with the central portion defined by the second spacer, wherein air can flow through the at least one aperture in the second front face, into the central portion defined by the second spacer, and out the side apertures in the third wall.

5. A connector, comprising:

a cage with a front face, the cage including a top wall, a first and second side wall and a rear wall, the wall cooperatively forming a hollow interior space;

a housing with at least a first card slot and at least a second card slot positioned in the hollow interior space, the at least first car slot and at least second card slot vertically spaced apart;

a first spacer positioned between the first and second side wall and between the at least first card slot and at least second card slot so as to define a first and second bay, the first spacer defining a central portion between the first and second bay, the central portion having a length that extend from the front face to the housing; and a first front face aligned with the central portion, the first front face including at least one front aperture that is in communication with the central portion, wherein the first and second side wall each have a plurality of side apertures in communication with the central portion so as to allow air to flow through the at least one front aperture, along the central portion and out the side apertures, wherein the side apertures are positioned at least one third of the length of the central portion from the first front face, wherein the spacer includes a bottom wall with a large opening that extends longitudinally along the bottom wall, wherein the large opening defines an area that is at least 25% of the area defined by the bottom wall.

6. The connector of claim 5, wherein the large opening defines an area that is at least 33% of the area defined by the bottom wall.

7. The connector of claim 6, wherein the large opening has a length that is at least 50% of the length of one of the module-receiving bays.

8. The connector of claim 1, wherein the cage includes a bottom wall, the bottom wall configured to be mounted on circuit board.

9. The connector of claim 1, wherein the opening in the front face and the apertures on the first and second side walls are positioned at vertices of an imaginary triangle.

10. The connector of claim 1, wherein the apertures on the first and second side wall are aligned with each other.

11. The connector of claim 1, wherein the front face is conductive.

12. A cage assembly with a front face, comprising:

a first wall with a first side aperture;

a second wall, the second wall oriented substantially parallel to the first wall and include a second side aperture opposite the first side aperture;

a third wall extending between the first and second wall, the third wall configured to provide a top wall;

a fourth wall extending between the first and second wall and configured to form a rear wall; and a fifth wall and sixth wall spaced apart and extending between the first and second wall in a substantially parallel configuration on opposite sides of the first side aperture and second side aperture so as to form a center portion therebetween and to define a first and second bay, the fifth wall being closer to the third wall and defining the first bay, the sixth wall including a large opening so that the second bay formed by first, second and sixth wall is in communication with the central portion via the aperture, the first, second, third, fifth and sixth walls extending from the front face, wherein the sixth wall has a first area facing the bay and the large opening has a second area, wherein the second area is at least twenty five (25) percent of the first area.

13. The cage assembly of claim 12, wherein the second area is at least thirty three (33) percent of the first area.

14. The cage assembly of claim 12, wherein the sixth wall has a first length extending from a front face toward the rear wall and the first and second side aperture are positioned a distance from the front face, the distance being at least one third the first length.

15. The cage assembly of claim 14, wherein the distance is at least one half of the first length.

* * * * *